US006559579B2

(12) United States Patent
Ito et al.

(10) Patent No.: US 6,559,579 B2
(45) Date of Patent: May 6, 2003

(54) ALUMINA-BASED SINTERED BODY INSULATOR FOR SPARK PLUGS

(75) Inventors: Hirohito Ito, Konan (JP); Kenji Nunome, Nagoya (JP); Makoto Sugimoto, Nagoya (JP); Kuniharu Tanaka, Komaki (JP); Katsura Matsubara, Iwakura (JP); Yoshihiro Yamamoto, Kasugai-gun (JP); Masaya Ito, Nisshin (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 220 days.

(21) Appl. No.: 09/725,180

(22) Filed: Nov. 29, 2000

(65) Prior Publication Data

US 2001/0004184 A1 Jun. 21, 2001

(30) Foreign Application Priority Data

Nov. 29, 1999 (JP) ..... 11-337167

(51) Int. Cl.[7] ..... H01T 13/20; H01T 13/00; H01T 13/02; F02M 57/06; F02P 13/00

(52) U.S. Cl. ..... 313/143; 313/118; 313/141; 313/142; 313/130; 313/137

(58) Field of Search ..... 313/118, 130, 313/137, 143

(56) References Cited

U.S. PATENT DOCUMENTS 4,582,813 A 4/1986 Kanda et al.
5,104,834 A 4/1992 Watanabe et al.
5,760,532 A * 6/1998 Makoto et al. ..... 313/130
5,866,491 A 2/1999 Unno ..... 501/127
6,369,501 B1 * 4/2002 Aoki et al. ..... 313/486
6,388,376 B1 * 5/2002 Negishi et al. ..... 313/310

FOREIGN PATENT DOCUMENTS

| | | |
|---|---|---|
| DE | 24 48 888 | 4/1976 |
| EP | 0 954 074 A2 | 11/1999 |
| JP | 59-152263 | 8/1984 |
| JP | 62-100474 | 5/1987 |
| JP | 62-143866 | 6/1987 |
| JP | 2-22166 | 1/1990 |
| JP | 5-279114 | 10/1993 |
| JP | 7-17436 | 3/1995 |
| JP | 8-235933 | 9/1996 |
| JP | 2564842 | 10/1996 |
| JP | 9-249448 | 9/1997 |

* cited by examiner

*Primary Examiner*—Nimeshkumar D. Patel
*Assistant Examiner*—Anthony T. Perry
(74) *Attorney, Agent, or Firm*—Morgan, Lewis & Bockius LLP

(57) ABSTRACT

An insulator for spark plug comprises an alumina-based sintered body comprising: $Al_2O_3$ as a main component; and at least one component (hereinafter referred to as "β component") selected from the group consisting of Ca component, Sr component and Ba component, wherein the alumina-based sintered body comprises particles comprising a compound comprising the β component and Al component, the compound having a molar ratio of the Al component to the β component of 4.5 to 6.7 as calculated in terms of oxides thereof, and has a relative density of 90% or more.

6 Claims, 3 Drawing Sheets

ALUMINA-BASED SINTERED BODY INSULATOR FOR SPARK PLUGS

BACKGROUND OF THE INVENTION

1. Field of the Invention

The present invention relates to a spark plug to be used as a source for igniting a mixed gas in an internal combustion engine and an insulator to be incorporated in such a spark plug.

2. Description of the Related Art

The insulator for spark plug (hereinafter referred as "insulator") constituting the spark plug for use in internal combustion engines such as automobile engine is normally formed by an alumina-based sintered body obtained by sintering an alumina ($Al_2O_3$)-based insulation material. This is because alumina ceramics are excellent in heat resistance, mechanical strength, dielectric strength, etc. In particular, the insulator for spark plug is liable to exposure to a heat of from about 500° C. to 700° C. developed by the combustion (about 2,000° C. to 3,000° C.) of a gas ignited by spark discharge in the combustion chamber of internal combustion engine. Thus, it is important that the insulator for spark plug is excellent in dielectric strength over a temperature range of from room temperature to the foregoing high temperature. Such an insulator (alumina-based sintered body) has heretofore been formed by, e.g., a three-component system comprising silicon oxide ($SiO_2$) calcium oxide (CaO) and magnesium oxide (MgO) as a sintering aid for the purpose of lowering the required sintering temperature and improving the sinterability.

However, the insulator formed merely by the foregoing three-component system sintering aid is disadvantageous in that the three-component system sintering aid (mainly composed of Si component) is present as a low melting glass phase on boundaries of alumina crystal particles after sintering. Thus, when the insulator is exposed to a heat of around 700° C., the heat effect causes the low-melting glass phase to soften, possibly resulting in the deterioration of dielectric strength of the insulation material. It can be therefore proposed to merely reduce the amount of such a sintering aid to be added during the formation of the insulator for the purpose of reducing the occurrence of low-melting glass phase. However, this approach is disadvantageous in that the densification of insulator cannot proceed. Even if the densification of insulator proceeds apparently, numeral pores remain in boundaries of alumina crystal particles, possibly causing the deterioration of dielectric strength of insulator.

For the purpose of densifying the insulator, JP-A-62-100474 (The term "JP-A" as used herein means an "unexamined published Japanese patent application") proposes that a raw material composition obtained by granulating a raw material powder comprising alumina powder and the foregoing three-component system sintering aid to a predetermined particle diameter be blended with the same raw material composition which has not been granulated to reduce the amount of residual pores present on boundaries of alumina-based sintered body. JP-A-62-143866 proposes that a raw material powder comprising two alumina powders having different particle diameters and the foregoing three-component system sintering aid be sintered to reduce the amount of residual pores present on boundaries of alumina-based sintered body.

For the purpose of improving the dielectric strength of glass phase present on boundaries of alumina crystal particles, JP-B-7-17436 (The term "JP-B" as used herein means an "examined Japanese patent application"), for example, proposes that an alumina-based sintered body be formed by a sintering aid such as $Y_2O_3$, $La_2O_3$ and $ZrO_2$ to reduce the amount of residual pores and raise the melting point of glass phase present on boundaries of alumina crystal particles. Further, Japanese Patent 2564842 proposes that an alumina powder as a main component be blended with an organic metal compound and an aluminum compound to prepare a raw material powder having $Y_4Al_2O_9$ phase uniformly dispersed in uniform alumina crystal particles at triple point so that the dielectric strength of the resulting alumina-based sintered body can be improved.

In recent years, with the enhancement of output of internal combustion engines and the reduction of the size of engines, the inlet valve and exhaust value have occupied more in the combustion chamber and the size of the spark plug has been reduced. Thus, the insulator constituting the spark plug has been required to be thinner and hence have a higher dielectric strength. Under these circumstances, however, even an insulator formed by the alumina-based sintered body according to the foregoing various patents can hardly meet the requirements for dielectric strength at a temperature as high as around 700° C. sufficiently. Accordingly, such an insulator can undergo dielectric breakdown.

SUMMARY OF THE INVENTION

An object of the present invention is to provide a spark plug comprising an insulator containing alumina as a main component, which is less liable to occurrence of dielectric breakdown due to the effect of residual pores or low-melting glass phase present on boundaries of alumina-based sintered body constituting the insulation material and exhibits a higher dielectric strength at a temperature as high as around 700° C. than the conventional materials and an insulator for use in such a spark plug.

The insulator for spark plug according to the invention which has been worked out to solve the foregoing problems comprises an alumina-based sintered body comprising $Al_2O_3$ (alumina) as a main component and at least one component (hereinafter referred to as "β component") selected from the group consisting of Ca (calcium) component, Sr (strontium) component and Ba (barium) component, the alumina-based sintered body having at least partly particles including a compound comprising the β component and Al (aluminum) component at an Al to β molar ratio of from 4.5 to 6.7 as calculated in terms of oxides thereof and having a relative density of 90% or more.

It is most noteworthy in the invention that the alumina-based sintered body comprising alumina as a main component comprises at least partly particles of a compound comprising β component and Al component at a molar ratio ($Al_2O_3/\beta O$) of from 4.5 to 6.7 as calculated in terms of oxides thereof.

Since it can be presumed that the foregoing compound comprising specific components at a specific molar ratio is a compound having a high melting point, an insulator for spark plug formed by an alumina-based sintered body with particles made of such a compound present thereon can be provided with an extremely excellent dielectric strength at a temperature as high as around 700° C. as compared with conventional insulators comprising alumina as a main component. Examples of the foregoing compound having a molar ratio ($Al_2O_3/\beta O$) of from 4.5 to 6.7 include $BaAl_{9.2}O_{14.8}$, (molar ratio: 4.6; β component: Ba component), and $BaAl_{13.2}O_{20.8}$, (molar ratio: 6.6; β component: Ba component). Alternatively, compounds other than hexaaluminate and analogy thereof may be used.

The term "particles" as used herein is meant to indicate particles other than alumina particles observed on cut area obtained by cutting the insulator. The presence of these particles can be easily confirmed by mirror-polishing the cut surface of the insulator, and then observing the cut surface under SEM. If necessary, the presence of these particles may be confirmed by observing under TEM. Subsequently, these particles can be subjected to EDS analysis to confirm that β component and Al component are present therein.

Subsequently, the presence of the "compound" contained in the foregoing particles can be confirmed by various measuring methods. By way of example, an insulator which has been confirmed for the presence of particles comprising β component and Al component by observation under SEM and EDS analysis can be crushed to give a powder which is then subjected to X-ray diffractometry to see if there occurs a spectrum corresponding to the compound having a molar ratio ($Al_2O_3/\beta O$) of from 4.5 to 6.7. If there is a spectrum corresponding to such a compound, it can be judged that the compound is present. In this X-ray diffractometry, if β component is Ba component, extremely similar spectra may be given with respect to X-ray diffractometry chart of $BaAl_{9.2}O_{14.8}$ (molar ratio: 4.6), $BaAl_{12}O_{19}$ (molar ratio: 6.0) and $BaAl_{13.2}O_{20.8}$ (molar ratio: 6.6), occasionally making it impossible to judge which compound is present. However, even in the case where any of the foregoing compounds is present, an effect of improving the dielectric strength at a temperature as high as around 700° C. can be exerted so far as the foregoing molar ratio ($Al_2O_3/\beta O$) falls within the range of from 4.5 to 6.7. Methods other than X-ray diffractometry (e.g., EPMA analysis) may be used to confirm the presence of the foregoing compound. It should be noted that different measuring methods may give a difference in molar ratio even with the same insulator. However, any measuring method makes it possible to exert an effect of improving the dielectric strength at a temperature as high as around 700° C. so far as the foregoing molar ratio ($Al_2O_3/\beta O$) falls within the predetermined range.

The site at which such particles are present is not specifically limited. The particles are preferably present in the interior of the insulator, more preferably on particle-particle boundaries and/or triple point of alumina. Further, these particles don't need to be uniformly present in the alumina-based sintered body. These particles can be present intensively on the site where desired dielectric strength is required to exert an effect of improving dielectric strength. The shape of these particles is not specifically limited.

It is presumed that when the foregoing molar ratio ($Al_2O_3/\beta O$) falls below 4.5 or exceeds 6.7, the compound formed by these specific components can have structural defects and thus exhibits deteriorated dielectric strength at a temperature as high as around 700° C., although the reason for this phenomenon is unknown.

Further, in accordance with the present invention, it is important that the insulator not only comprises particles made of a compound comprising β component and Al component at a molar ratio ($Al_2O_3/\beta O$) of from 4.5 to 6.7 as calculated in terms of oxide thereof but also has a relative density of not less than 90%. When the relative density of the insulator falls below 90%, many residual pores into which an electric field can be easily concentrated are present in the insulator, possibly causing the deterioration of improvement of dielectric strength at a temperature as high as around 700° C. The term "relative density" as used herein is meant to indicate the percentage of the density of the sintered body measured by Archimedes' method per the theoretical density of the sintered body. The term "theoretical density" as used herein is meant to indicate the density obtained by converting the content of the various elements contained in the sintered body to an oxide basis, and then subjecting the results to calculation according to mixing theory. The more the relative density is, the more dense is the sintered body and hence the less is the amount of residual pores, i.e., the higher is the dielectric strength.

As mentioned above, the insulator according to the invention exhibits an excellent dielectric strength at a temperature as high as around 700° C. as compared with the conventional spark plug. Hence, when applied to small-sized spark plug requiring a thin insulator or when applied to spark plug for high output internal combustion engine which exhibits a high temperature in the combustion chamber, the insulator according to the invention can effectively prevent troubles such as dielectric breakdown (penetration of spark).

Referring to the insulator for spark plug of the invention, it is judged that particles comprising a compound contributing to the improvement of dielectric strength have been formed when the molar ratio ($Al_2O_3/\beta O$) of β component and Al component as calculated in terms of oxide falls within the predetermined range as mentioned above. Thus, the content of Al component and β component in the alumina-based sintered body are not specifically limited themselves. In order to obtain a good dielectric strength at a temperature as high as around 700° C., however, it is preferred that Al component and β component be incorporated in the alumina-based sintered body in an amount of from 80.0% to 99.8% by weight (more preferably from 91.0 to 99.7% by weight) and from 0.2 to 10% by weight, respectively, based on 100% by weight of the alumina-based sintered body.

In the insulator for spark plug of the invention, the compound contained in the foregoing particles is preferably $\beta Al_{12}O_{19}$ phase. The $\beta Al_{12}O_{19}$ phase can be confirmed when charts similar to JCPDS (Joint Committee on Powder Diffraction Standards) card Nos. 38-0470, 26-0976 and 26-0135 on X-ray diffraction spectrum are obtained. JPSD card Nos. 38-0470, 26-0976 and 26-0135 indicate $CaAl_{12}O_{19}$ phase, $SrAl_{12}O_{19}$ phase and $BaAl_{12}O_{19}$ phase, respectively.

The reason why the dielectric strength of the insulator is enhanced when particles containing $\beta Al_{12}O_{19}$ crystal phase are present at least locally in the alumina-based sintered body is unknown. This $\beta Al_{12}O_{19}$ crystal phase is an ideal crystal structure among so-called hexaaluminate crystal structures and thus exhibits a high melting point as compared with other crystal structures having defects, presumably enhancing the dielectric strength at a temperature as high as around 700° C. Regardless of which the particles present at least locally in the insulator (alumina-based sintered body) are composed of $\beta Al_{12}O_{19}$ phase alone or along with other crystal, an effect of improving the dielectric strength can be exerted.

The insulator for spark plug of the invention may also comprise a silicon (Si) component. In this case, the molar ratio of content of silicon component and the foregoing β component as calculated in terms of oxide preferably satisfies the relationship $SiO_2/(SiO_2+\beta O) \leqq 0.8$.

The Si component can easily melt to form a liquid phase during sintering to act as a sintering aid for accelerating the densification of the insulator. Thus, the incorporation of the Si component makes it possible to effectively enhance the densification of the insulator.

The foregoing Si component acts as a sintering aid for acceleration densification as well as exists as a low-melting glass phase on particle-particle boundaries of alumina crystal. In the present invention, when the insulator has particles made of a compound comprising β component and Al component at a molar ratio ($Al_2O_3/\beta O$) of from 4.5 to 6.7 as calculated in terms of oxide, an effect of improving dielectric strength can be effectively exerted. Thus, the presence of particles having the foregoing properties on particle-particle boundaries in the alumina-based sintered body makes it possible to raise the melting point of particle-particle boundaries as compared with low-melting glass phase alone. It is important to adjust the proportion of Si component according to the foregoing relationship. This is because the adjustment of the proportion of Si component according to the foregoing relationship makes it possible to effectively produce particles having the foregoing properties on particle-particle boundaries during sintering. As a result, an effect of improving the dielectric strength of the insulator at a temperature as high as around 700° C. can be effectively exerted.

The spark plug of the invention comprises an axial center electrode, a metal shell provided around the center electrode in a radial direction, a ground electrode fixed to the metal shell at one end thereof opposed to the center electrode, and an insulator for spark plug as shown above provided around the center electrode in a radial direction interposed between the center electrode and the metal shell. In this arrangement, a spark plug can be formed having an insulator which exhibits an excellent dielectric strength at a temperature as high as around 700° C. and can hardly undergo dielectric breakdown (penetration of spark).

DETAILED DESCRIPTION OF THE INVENTION

Some embodiments of implication of the present invention will be described hereinafter in connection with the attached drawings.

Figure 1:
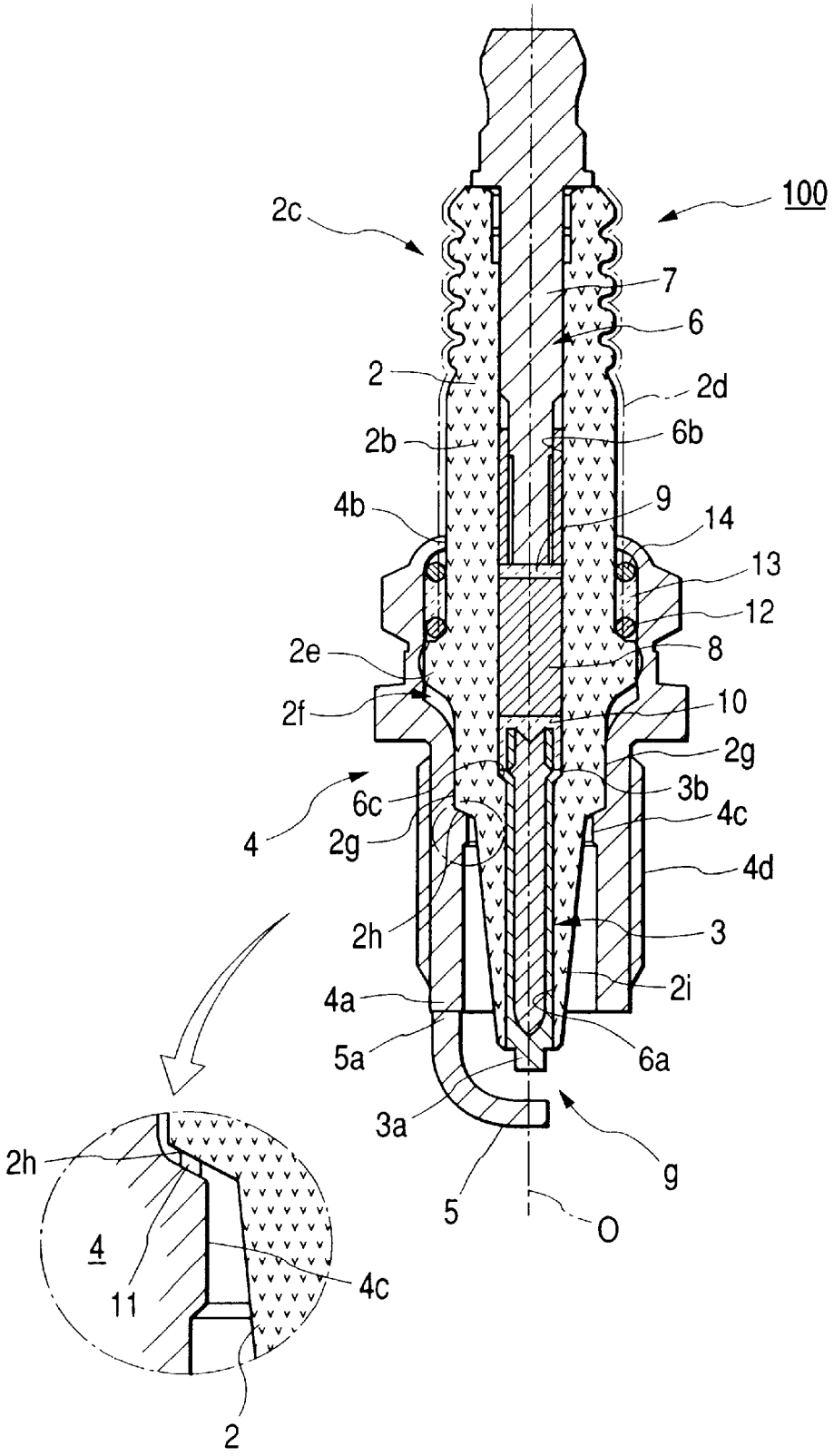
FIG. 1 is a general front sectional view illustrating an embodiment of the spark plug according to the present invention.

A spark plug 100 shown as an embodiment of the spark plug of the present invention in FIG. 1 comprises an axially extending center electrode 3, an insulator 2 provided around the center electrode 3 in a radial direction, and a metal shell 4 retaining the insulator 2. The metal shell 4 is formed by, e. g., carbon steel (JIS-G3507). A ground electrode 5 is fixed at one end 5*a* thereof to the metal shell 4 at one forward end 4*a* thereof by welding. The ground electrode 5 extends at the other end toward the forward end 3*a* of the center electrode and bends in the form of L to form a predetermined spark gap g with respect to the center electrode 3 (at the forward end 3*a*).

The insulator 2 which is an essential part of the spark plug of the invention has a through-hole 6 formed along its central axis O. A terminal 7 is received and fixed in the through-hole 6 at one end thereof. Similarly, a center electrode 3 is received and fixed in the through-hole 6 at the other end thereof. A resistor 8 is provided in the through-hole 6 interposed between the terminal 7 and the center electrode 3. The resistor 8 is electrically connected to the center electrode 3 and the terminal 7 via electrically-conductive glass layers 9 and 10, respectively, at the respective ends thereof. The resistor 8 is formed by a resistor composition obtained by mixing a glass powder and an electrically-conductive material powder (and optionally ceramics powder other than glass powder), and then sintering the mixture under hot press or the like. Alternatively, the resistor 8 may be omitted to give a structure comprising a center electrode 8 and a terminal 7 integrated with a single electrically-conductive glass seal layer.

The insulator 2 has a through-hole 6 in which the center electrode 3 is fitted along its central axis 0. The insulator 2 is generally formed by an insulation material of the invention. The insulation material to be used herein is formed by an alumina-based sintered body mainly composed of alumina ($Al_2O_3$) and comprising β component (at least one selected from the group consisting of calcium (Ca) component, strontium (Sr) component and barium (Ba) component).

Referring further to the insulator 2, it has a flange-like protrusion 2*e* formed in the middle portion of the length thereof protruding radially and outwardly as shown in FIG. 1. The insulator 2 comprises a main body 2*b* having a forward portion lying toward the forward end of the center electrode 3 and a portion formed behind the protrusion 2*e* thinner than the protrusion 2*e*. On the other hand, the insulator 2 comprises a first axial portion 2*g* ahead the protrusion 2*e* thinner than the protrusion 2*e* and a second axial portion 2*i* formed ahead the first-axial portion 2*g* thinner than the first axial portion 2*g*. The main body 2*b* has a glaze 2*d* coated on the periphery of the main body 2*b* and a corrugation 2*c* formed on the reward end of the periphery thereof. The first axial portion 2*g* has a substantially cylindrical periphery. The second axial portion 2*i* has a substantially conical periphery which narrows toward its forward end.

The through-hole 6 in the insulator 2 has a substantially cylindrical first portion through which the center electrode 3 is received in the through-hole 6 and a substantially cylindrical second portion 6*b* formed behind the first portion 6*a* (upward as viewed on the figure) larger in diameter than the first portion 6*a*. As shown in FIG. 1, the terminal 7 and the resistor 8 are received in the second portion 6*b*, and the center electrode 3 is provided extending through the first portion 6*a*. The center electrode 3 has a raised portion 3*b* for fixing electrode formed protruding radially and outwardly. The first portion 6*a* and the second portion 6*b* of the through-hole 6 are connected to each other in the first axial portion. At this connecting position, a tapered or curved raised portion-receiving surface 6*c* for receiving the electrode fixing raised portion 3*b* of the center electrode 3 is formed.

The portion 2*h* at which the first axial portion 2*g* and the second axial portion 2*i* are connected to each other has a stepped periphery. The stepped periphery is engaged with a raised portion 4*c* formed as an engagement portion for the part of metal shell on the inner surface of the metal shell 4 via an annular plate packing to prevent the insulator 2 from sliding along the axis. On the other hand, an annular linear packing 12 is provided interposed between the inner surface of the rear opening of the metal shell 4 and the outer surface of the insulator 2 engaging with the rear edge of the flange-like raised portion 2*e*. An annular linear packing 14 is provided behind the linear packing 12 with the interposition of a powdered talc 13. Thus, by inserting the insulator 2 into the through-hole forward toward the metal shell 4, and then caulking the opening edge of the metal shell 4 inwardly toward the linear packing 14 to make a curved surface, a caulked portion 4*b* is formed to fix the metal shell 4 to the insulator 4.

Figure 2A:
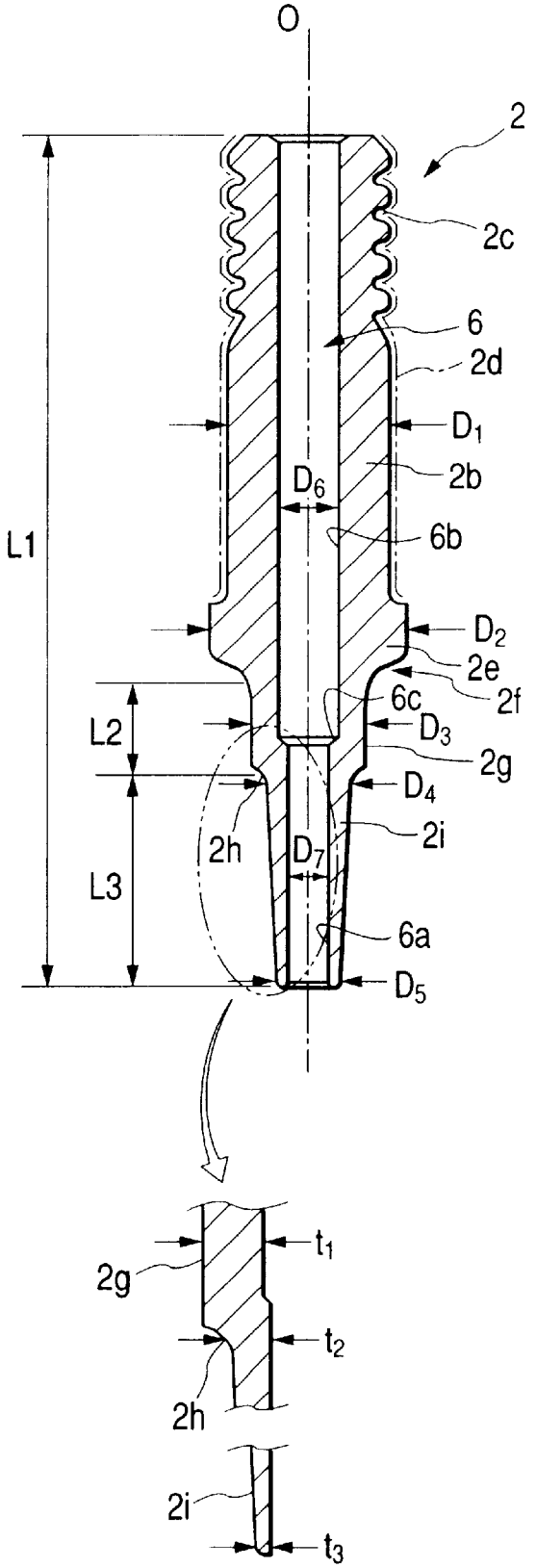
FIGS. 2A and 2B are vertical sections illustrating some embodiments of the insulation material for spark plug.
Figure 2B:
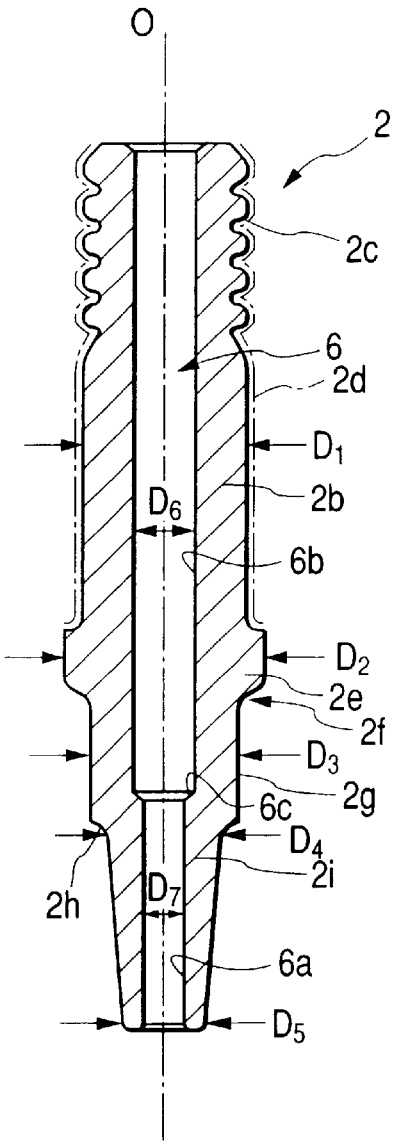

FIG. 2A and FIG. 2B illustrate some embodiments of the insulator 2. The size of various portions of these embodiments.

Total length L1: 30 to 75 mm

Length L2 of first axial portion: 0 to 30 mm (with the proviso that the portion 2*f* at which it is connected to the raised portion 2*e* is excluded and the portion 2*h* at which it is connected to the second axial portion 2*i* is included)

Length L3 of second axial portion 2*i*: 2 to 27 mm

Outer diameter D1 of main body 2*b*: 9 to 13 mm

Outer diameter D2 of raised portion 2*e*: 11 to 16 mm

Outer diameter D3 of first axial portion 2*g*: 5 to 11 mm

Outer diameter D4 of second axial portion 2*i* on the base side: 3 to 8 mm Outer diameter D5 of second axial portion 2*i* on the forward end (with the proviso that when the second axial portion is curved or beveled at its forward edge, the outer diameter indicates the outer diameter at the curved or beveled surface on a section including the central axis 0): 2.5 to 7 mm Inner diameter D6 of second portion 6*b* of through-hole 6: 2 to 5 mm Inner diameter D7 of first portion 6*a* of through-hole 6: 1 to 3.5 mm Thickness t1 of first axial portion 2*g*: 0.5 to 4.5 mm Thickness t2 of base portion of second axial portion 2*i* (perpendicular to central axis 0): 0.3 to 3.5 mm Thickness t3 of forward end of second axial portion 2*i* (perpendicular to central axis 0, with the proviso that when the second axial portion is curved or beveled at its forward edge, the thickness of the forward end indicates the thickness of the curved or beveled surface at the base end on a section including the central axis 0): 0.2 to 3 mm Average thickness tA ((t2+t3)/2) of second axial portion 2*i*: 0.25 to 3.25 mm The size of the foregoing various portions of the insulator 2 shown in FIG. 2A are as follows, for example: L1: about 60 mm; L2: about 10 mm; L3: about 14 mm; D1: about 11 mm; D2: about 13 mm; D3: about 7.3 mm, D4: 5.3 mm; D5: about 4.3 mm; D6: 3.9 mm; D7: 2.6 mm; t1: 1.7 mm; t2: 1.3 mm; t3: 0.9 mm; tA: 1.1 mm The insulator 2 shown in FIG. 2B has a first axial portion 2*b* and a second axial portion 2*i* both having a slightly greater outer diameter than that shown in FIG. 2A. The size of the various portions are as follows, for example: L1: about 60 mm; L2: about 10 mm; L3: about 14 mm; D1: about 11 mm; D2: about 13 mm; D3: about 9.2 mm; D4: 6.9 mm; D5: about 5.1 mm; D6: 3.9 mm; D7: 2.7 mm; t1: 3.3 mm; t2: 2.1 mm; t3: 1.2 mm; tA: 1.65 mm.

The insulator 2 may be produced by, e.g., the following method. Firstly, alumina ($Al_2O_3$) powder, silicon (Si) powder and optionally magnesium (Mg) component and β component are blended as raw material powders. To the mixture are then added a hydrophilic binder (e.g., polyvinyl alcohol) and water as a solvent. The mixture is then stirred to prepare a moldable basic slurry.

As the alumina powder to be used as a main component of the raw material powder there may be used one having an average particle diameter of 2.0 μm or less. When the average particle diameter of alumina powder exceeds 2.0 μm the densification of the sintered body itself can hardly proceed thoroughly, occasionally resulting in the deterioration of dielectric strength of the insulator. The alumina powder constituting raw material powder is preferably incorporated in the alumina-based sintered body in an amount of from 80.0 to 99.7% by weight, more preferably from 91.0 to 99.0% by weight as calculated in terms of oxide of Al component to obtain a high dielectric strength.

β component, Si component and Mg component may be used in the form of oxide thereof (or composite oxide thereof) as well as in the form of various inorganic powders such as hydroxide powder, carbonate powder, chloride powder, sulfate powder, nitrate powder and phosphate powder. For example, Ca component or Ba component as β component, Si component and Mg component may be blended in the form of $CaCO_3$ powder or $BaCO_3$ powder, $SiO_2$ powder and MgO powder, respectively. These inorganic powders each need to be in the form that can be oxidized to oxide when sintered at a high temperature in the atmosphere.

Among the inorganic powders to be added, β component powder preferably has an average particle diameter of 1.0 μm or less. When the average particle diameter of β component exceeds 1.0 μm, the reaction of β component with Al component doesn't proceed thoroughly, presumably making it impossible to fairly produce particles made of a compound comprising β component and Al component at a molar ratio of from 4.5 to 6.7 as calculated in terms of oxide. β component is preferably incorporated in the alumina-based sintered body in an amount of from 0.2 to 10.0% by weight as calculated in terms of oxide to obtain a high dielectric strength.

Among the inorganic powders to be added, Si component needs to be added in an amount such that the molar ratio of Si component and the foregoing β component satisfies the relationship $SiO_2/(SiO_2+\beta O)$ as calculated in terms of oxide. The content of Si component as calculated in terms of oxide can be calculated based on the content of the foregoing β component as calculated in terms of oxide. Si component and β component can be added taking into account the sum of the content of Al component and β component as calculated in terms of oxide. Mg component is preferably incorporated in the alumina-based sintered body in an amount of 5% by weight or less, more preferably 3% by weight or less as calculated in terms of oxide to obtain a high dielectric strength. These inorganic powders, including Si component and Mg component, preferably have an average particle diameter of 1 μm or less.

Water to be used as a solvent in the preparation of moldable basic slurry is not specifically limited. The same water as used in the preparation of the conventional insulation material may be used. As the binder there may be used a hydrophilic organic compound. Examples of the hydrophilic organic compound employable herein include polyvinyl alcohol (PVA), water-soluble acrylic resin, gum arabic, and dextrin. Most preferred among these hydrophilic organic compounds is PVA. The method for the preparation of moldable basic slurry is not specifically limited. Any mixing method may be used so far as the raw material powder, binder and water can be mixed to form a moldable basic slurry. The binder and water may be incorporated in an amount of from 0.1 to 5 parts by weight, particularly from 0.5 to 3 parts by weight, and from 40 to 120 parts by weight, particularly from 50 to 100 parts by weight, respectively, based on 100 parts by weight of the raw material powder.

The moldable basic slurry is then dried by spray drying method or the like to prepare a spherically particulate moldable basic granulated material. The granulated material thus obtained preferably has an average particle diameter of from 30 μm to 200 μm, particularly from 50 μm to 150 μm. The moldable basic granulated material is then rubber press-molded to obtain a press-molded product as an original of the insulation material. The press-molded product thus obtained is then subjected to cutting on the periphery thereof over a resinoid wheel so that it is finished to an external shape corresponding to that of FIGS. 2A and 2B. The molded product is then sintered at a temperature of from 1,500° C. to 1,700° C. in the atmosphere for 1 to 8 hours. The molded product is glazed, and then finishing-sintered to complete an insulator 2. When the molded product is kept in the foregoing sintering temperature range, an arbitrary temperature within the foregoing range may be maintained for a predetermined period of time or the temperature may be varied according to a predetermined heating pattern within the foregoing range for a predetermined period of time.

The operation of the spark plug 100 will be described hereinafter. In some detail, the spark plug 100 is mounted on the engine block via a thread portion 4*d* formed on the metal shell 4 so that it can be used as a source for igniting a mixed gas introduced into the combustion chamber. The insulator used in the spark plug 100 can be formed by the insulation material of the invention to have a raised dielectric strength at a temperature as high as around 700° C. Even when used in a high output engine which exhibits a high temperature in its combustion chamber, the spark plug 100 thus obtained can hardly undergo dielectric breakdown (penetration of spark) and thus can be provided with a high reliability.

If an axial portion which is smaller in diameter and thinner than the engaging raised portion 2*e* (combination of the first axial portion 2*g* and the second axial portion 2*i* in this case) is formed ahead the engaging raised portion 2*e* as shown in FIGS. 2A and 2B, for example, the axial portion, e.g., second axial portion 2*i* can easily undergo dielectric breakdown (penetration of spark) Accordingly, the insulation material of the invention is useful particularly for such an insulator 2. In the insulator of FIG. 2A, for example, the average thickness tA of the second axial portion 2*i* is defined to be 1.1 mm. However, even when the insulator of the invention is formed to this small thickness around the center electrode 3, troubles such as dielectric breakdown (penetration of spark) can be effectively prevented or inhibited.

The spark plug to which the present invention can be applied is not limited to the type shown in FIG. 1. The spark plug may be in a form comprising a plurality of ground electrodes arranged opposed to the side face of a center electrode at the forward end thereof such that a spark gap is formed. In this case, the spark plug may be of semi-surface discharge type comprising the forward end of an insulator inserted between the side surface of the center electrode and the forward surface of the ground electrode. In this arrangement, spark discharge is made along the surface of the forward end of the insulator, making it possible to enhance resistance to smoke or the like, as compared with air discharge type spark plug.

The following experiments were conducted to confirm the effect of the invention.

To an alumina powder having an average particle diameter of 0.4 μm (purity: 99.8% or more) were added at least one or more powders selected from the group consisting of $CaCO_3$ powder having an average particle diameter of 0.8 μm (purity: 99.9%), $BaCO_3$ powder having an average particle diameter of 1.0 μm (purity: 99.9%) and $SrCO_3$ powder having an average particle diameter of 0.8 μm (purity: 99.9%) as β components and optionally $SiO_2$ powder having an average particle diameter of 0.6 μm (purity: 99.9%) and/or MgO powder having an average particle diameter of 0.3 μm (purity: 99.9%) as set forth in Table 1 in proportions as set forth in Table 1 to prepare a raw material powder.

To the raw material powder thus obtained were then added PVA as a hydrophilic binder and water as a solvent in an amount of 2 parts by weight and 70 parts by weight, respectively, based on 100 parts by weight of the total weight of the raw material powder. The mixture was then stirred by wet process in a ball mill with alumina balls to prepare moldable basic slurry. Subsequently, the moldable basic slurry thus obtained was then dried by a spray drying method to prepare a spherically particulate moldable basic granulated material. The granulated material was then sieved to a grain diameter of from 10 μm to 355 μm. The moldable basic granulated material thus obtained was put in a rubber press mold. The moldable basic granulated material was then rubber press-molded at a pressure of about 100 MPa with a rubber press pin for molding through-hole 6. The press-molded product thus obtained was then subjected to cutting on the periphery over a resinoid wheel to form a molded product of insulation material having a predetermined shape. Thereafter, the molded product was kept at a sintering temperature (highest sintering retention temperature) set forth in Table 1 in the atmosphere for 2 hours so that it was sintered. The molded product thus sintered was glazed, and then finishing-sintered to produce an insulator 2 as shown in FIG. 2A.

These insulators thus obtained were then each evaluated as follows. For the measurement of relative density, these insulators were measured for density (relative density) by Archimedes' method. The ratio of the measurement to the theoretical density obtained by mixing theory was then determined. The results are set forth in Table 2.

These insulators were each also subjected to chemical analysis for composition analysis as calculated in terms of oxide. From the results of composition analysis was then calculated the molar ratio of silicon component and β component in the insulator ($SiO_2/(SiO_2+\beta O)$) as calculated in terms of oxide. The results are set forth in Table 2.

Subsequently, particles present on the boundaries of alumina particles observed under SEM were subjected to EDS analysis to confirm the presence of particles containing at least Al component and β component in the alumina-based sintered body (insulation material). The results are set forth in Table 3. For the observation under SEM, the insulator was cut. The resulting cut area was then mirror-polished. A Type JSM-840 scanning electron microscope produced by JEOL Ltd. was used for measurement.

If the presence of the foregoing particles was confirmed after EDS analysis, the insulator was then subjected to powder X-ray diffractometry to confirm if a compound comprising Al component and β component at a molar ratio ($Al_2O_3/\beta O$) of from 4.5 to 6.7 as calculated in terms of oxide is contained in the insulator. The results of confirmation of whether or not the compound having a molar ratio ($Al_2O_3/\beta O$) of from 4.5 to 6.7 is present are set forth in Table 3. When the results of powder X-ray diffractometry show that there occurs diffraction peak of $\beta Al_{12}O_{19}$ phase, it can be judged that a compound having the foregoing molar ratio ($Al_2O_3/\beta O$) of 6.0 (i.e., $\beta Al_{12}O_{19}=6(Al_2O_3)*(\beta 0)$) is contained in the particles. If the particles have a sufficient size, they are subjected to EPMA analysis to determine the quantity of the various components. The results can be reduced to oxide basis to calculate the molar ratio ($Al_2O_3$/βO). For the powder X-ray diffractometry to be effected in the present example, the insulator was ground in an alumina mortar to particle size small enough to pass through a 300 mesh sieve. The powder thus obtained was then subjected to measurement by a Type RU-200T X-ray generator and a wide-angle goniometer with monochromator produced by Rigaku Corp. (measuring conditions: tube current: 100 m.A; tube voltage: 40 kV; step: 0.01°; scan speed: 2°/min).

Figure 3:
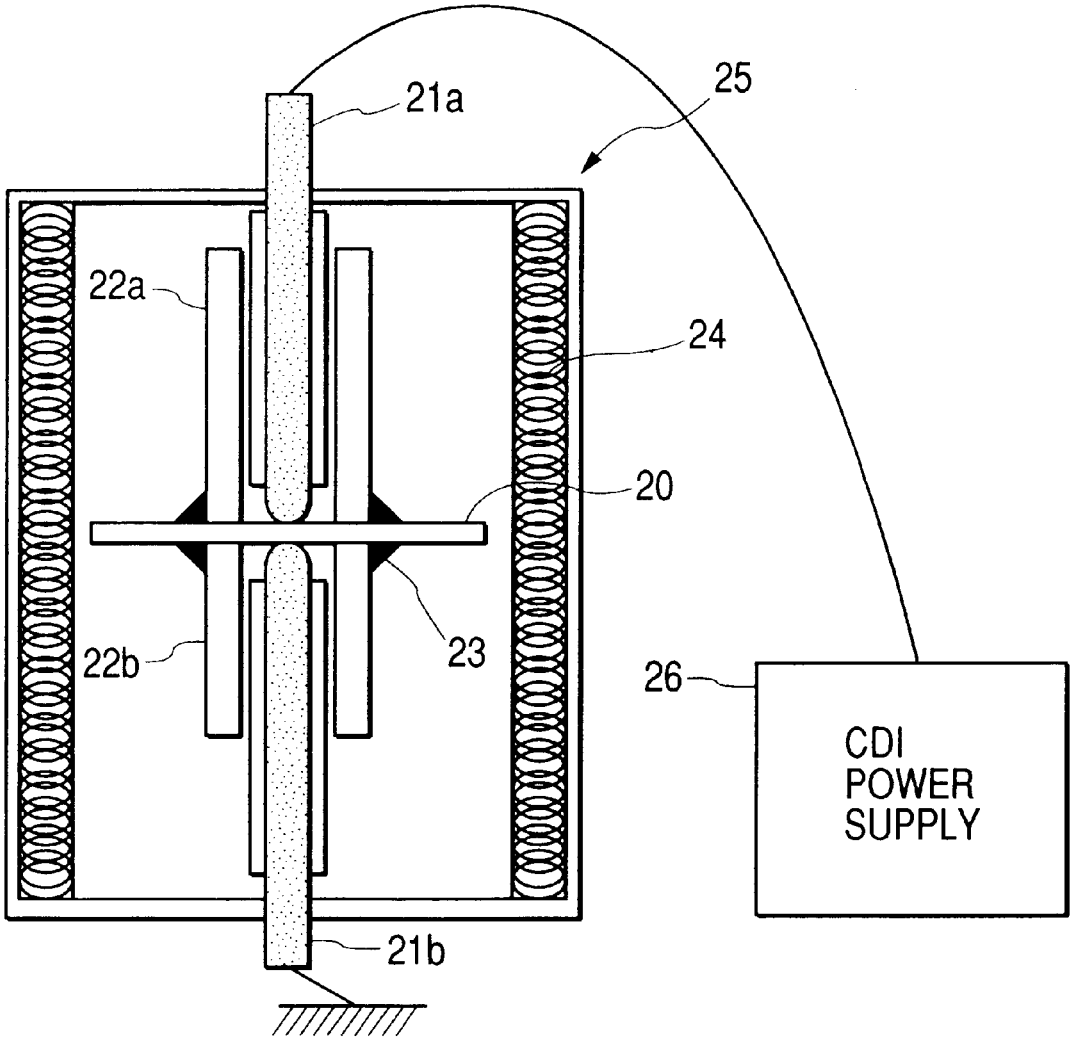
FIG. 3 is a schematic diagram illustrating an apparatus used to measure the dielectric strength of various specimens of examples at 700° C.

Subsequently, dielectric strength at 700° C. was measured. For the measurement of dielectric strength, the same moldable basic granulated material as used above was used to prepare a test piece to be measured for dielectric strength. In some detail, a moldable basic granulated material was formed by press molding (at a pressure of 100 MPa). The moldable basic granulated material thus formed was sintered under the same conditions as for the foregoing insulator to obtain a disc-shaped specimen having a diameter of 25 mm and a thickness of 0.65 mm. These specimens were each sandwiched between electrodes 21*a* and 21*b* and fixed by alumina cylindrical insulators 22*a* and 22*b* and a sealing glass 23 as shown in FIG. 3. The interior of a heating box 25 was heated to a temperature of 700° C. by an electric heater 24. Under these conditions, the initial insulation resistance and the dielectric strength shown when a voltage as high as scores of kilovolts from a high voltage generator (CDI power supply) 26 was applied to the specimen until it underwent dielectric breakdown were then measured. The results are set forth in Table 3.

The various insulators were each used to form a spark plug 100 shown in FIG. 1. These spark plugs 100 were each evaluated for dielectric strength as practical product. The diameter of the thread of the metal shell 4 of the spark plug 100 in the present example was 12 mm. The spark plug 100 was then mounted on a four-cylinder engine (piston displacement: 2,000 cc). The engine was then continuously run at full throttle and a rotary speed of 6,000 rpm with the highest discharge voltage being fixed to 35 kV and 38 kV and the temperature of the forward end (lower part of FIG. 1) of the insulator being fixed to a range of from 700° C. to 730° C. After 50 hours of running, the test specimen was then evaluated for occurrence of dielectric breakdown (penetration of spark) on the insulator 2. In Table 3 below, those showing no abnormalities on insulator after 50 hours of running were represented by the symbol 0 while those showing dielectric breakdown on insulator within 50 hours of running were represented by the symbol X.

TABLE 1

| Sample | Composition (parts by weight) | | | | | | Sintering temperature |
|---|---|---|---|---|---|---|---|
| No. | $Al_2O_3$ | $SiO_2$ | MgO | CaO | SrO | BaO | (° C.) |
| 1 | 90.25 | 2.5 | 0.25 | 2 | — | 5 | 1,625 |
| 2 | 98.5 | — | — | — | — | 1.5 | 1,650 |
| 3 | 90 | 4 | 0.5 | 0.5 | — | 5 | 1,625 |
| 4 | 99.2 | — | 0.1 | — | — | 0.7 | 1,650 |
| 5 | 95 | 1 | 3 | 1 | — | — | 1,575 |
| 6 | 98.5 | — | 0.5 | — | 1 | — | 1,650 |
| 7 | 98 | — | 0.5 | — | — | 1.5 | 1,650 |
| 8 | 93 | 1 | 3 | — | — | 3 | 1,625 |
| 9 | 96 | 1 | — | — | — | 3 | 1,650 |
| 10 | 95 | 2.5 | 0.5 | 2 | — | — | 1,550 |
| *11 | 97 | — | 3 | — | — | — | 1,650 |

TABLE 1-continued

| Sample | Composition (parts by weight) | | | | | | Sintering temperature |
|---|---|---|---|---|---|---|---|
| No. | $Al_2O_3$ | $SiO_2$ | MgO | CaO | SrO | BaO | (° C.) |
| *12 | 95 | 3.9 | — | — | — | 1.1 | 1,650 |
| *13 | 95 | 0.5 | 0.5 | 4 | — | — | 1,675 |

Note: The samples with the symbol * indicate comparative examples.

TABLE 2

| Sample | Composition of sintered body (% by weight) | | | | | | Relative density | $SiO_2$/($SiO_2$ + βO) |
|---|---|---|---|---|---|---|---|---|
| No. | $Al_2O_3$ | $SiO_2$ | MgO | CaO | SrO | BaO | (%) | |
| 1 | 90.2 | 2.54 | 0.26 | 2.02 | — | 4.98 | 93.3 | 0.38 |
| 2 | 98.4 | 0.07 | — | — | — | 1.49 | 97.2 | 0.11 |
| 3 | 89.9 | 4.04 | 0.50 | 0.50 | — | 4.98 | 95.1 | 0.62 |
| 4 | 99.1 | 0.09 | 0.11 | — | — | 0.70 | 98.7 | 0.25 |
| 5 | 94.9 | 1.05 | 2.99 | 0.99 | — | — | 96.5 | 0.50 |
| 6 | 98.4 | 0.06 | 0.51 | — | 0.99 | — | 97.6 | 0.09 |
| 7 | 97.9 | 0.05 | 0.50 | — | — | 1.49 | 97.8 | 0.08 |
| 8 | 93.0 | 1.02 | 2.99 | — | — | 2.98 | 95.6 | 0.47 |
| 9 | 96.0 | 1.03 | — | — | — | 2.98 | 95.9 | 0.47 |
| 10 | 94.9 | 2.56 | 0.51 | 2.03 | — | — | 94.3 | 0.57 |
| *11 | 96.9 | 0.06 | 3.01 | — | — | — | 96.5 | 1.00 |
| *12 | 94.8 | 3.93 | — | — | — | 1.09 | 96.1 | 0.90 |
| *13 | 94.9 | 0.49 | 0.50 | 4.02 | — | — | 89.3 | 0.10 |

Note: The samples with the symbol * indicate comparative examples.

TABLE 3

| Sample No. | Presence of particles containing Al and β | Presence of compound having molar ratio ($Al_2O_3$/βO) of from 4.5 to 6.7 | Insulation resistance (MΩ) | Dielectric strength (kV/mm) | Practical dielectric strength 35 kV | Practical dielectric strength 38 kV |
|---|---|---|---|---|---|---|
| 1 | 0 | 0 | 2,100 | 50 | 0 | 0 |
| 2 | 0 | 0 | 13,000 | 58 | 0 | 0 |
| 3 | 0 | 0 | 2,000 | 51 | 0 | 0 |
| 4 | 0 | 0 | 7,100 | 52 | 0 | 0 |
| 5 | 0 | 0 | 2,500 | 56 | 0 | 0 |
| 6 | 0 | 0 | 3,400 | 58 | 0 | 0 |
| 7 | 0 | 0 | 2,700 | 59 | 0 | 0 |
| 8 | 0 | 0 | 2,800 | 56 | 0 | 0 |
| 9 | 0 | 0 | 9,800 | 62 | 0 | 0 |
| 10 | 0 | 0 | 4,300 | 55 | 0 | 0 |
| *11 | X | — | 320 | 35 | X | X |
| *12 | X | — | 2,100 | 46 | 0 | X |
| *13 | 0 | 0 | 45 | 25 | X | X |

Note: The samples with the symbol * indicate comparative examples.

The results of Tables 2 and 3 show that Sample Nos. 1 to 10, which comprise an insulation material comprising an alumina-based sintered body having particles made of a compound comprising β component and Al component at a molar ratio ($Al_2O_3$/βO) of from 4.5 to 6.7 as calculated in terms of oxide thereof and having a relative density of 90% or more, exhibit a dielectric strength as good as 50 kV/mm or higher at 700° C. The spark plugs prepared from the insulation materials of Sample Nos. 1 to 10 undergo no dielectric breakdown on insulator under both 35 kV and 38 kV highest discharge voltages and thus exhibit excellent spark plug properties.

Some samples were found to contain components which had not been added during preparation when detected for composition. This is presumably because components which had been originally contained as impurities in the various raw materials were detected.

On the contrary, Comparative Sample Nos. 11 and 12, which comprise an insulation material comprising an alumina-based sintered body free of particles comprising at least β component and Al component (that is, free of particles made of a compound comprising β component and Al component at a molar ratio ($Al_2O_3/\beta O$) of from 4.5 to 6.7 as calculated in terms of oxide thereof), exhibit a dielectric strength of lower than 50 kV/mm at 700° C. Sample No. 12 exhibits a dielectric strength as low as 46 kV/mm at 700° C., demonstrating that even if the insulation material (alumina-based sintered body) comprises Ba component as β component, particles made of a compound having the foregoing molar ratio ($Al_2O_3/\beta O$) of from 4.5 to 6.7 are not effectively produced because the molar ratio ($SiO_2/(SiO_2+\beta O)$ exceeds 0.8 as calculated in terms of oxide, making it impossible to obtain a sufficient dielectric strength at around 700° C.

Sample No. 13, which comprises an insulation material (alumina-based sintered body) comprising particles made of a compound having the foregoing molar ratio ($Al_2O_3/\beta O$) of from 4.5 to 6.7 but having a relative density of less than 90%, exhibits the worst results among the samples of the present example, i.e., dielectric strength as low as 25 kV/mm at 700° C. This demonstrates that even if the insulation material comprises particles made of a compound having the foregoing molar ratio ($Al_2O_3/\beta O$) of from 4.5 to 6.7, an effect of improving dielectric strength at a temperature as high as around 700° C. cannot be exerted unless the insulation material has a relative density of 90% or more.

The entire disclosure of each and every foreign patent application from which the benefit of foreign priority has been claimed in the present application is incorporated herein by reference, as if fully set forth.

We claim:

1. An insulator for spark plug, which comprises an alumina-based sintered body comprising:

$Al_2O_3$ as a main component; and at least one component, hereinafter referred to as "β component", selected from the group consisting of Ca component, Sr component and Ba component, wherein the alumina-based sintered body comprises particles comprising a compound comprising the β component and Al component, the compound having a molar ratio of the Al component to the β component of 4.5 to 6.7 as calculated in terms of oxides thereof, and has a relative density of 90% or more.

2. The insulator for spark plug according to claim 1, wherein the compound contained in the particles is $\beta Al_{12}O_{19}$ phase.

3. The insulator for spark plug according to claim 1, wherein the alumina-based sintered body further comprises Si component, and the molar ratio of the Si component and the β component as calculated in terms of oxides thereof satisfies the following relationship:

$$SiO_2/(SiO_2+\beta O) \leqq 0.8$$

wherein βO represents an oxide of the β component.

4. The insulator for spark plug according to claim 1, wherein the alumina-based sintered body contains 80 to 99.7 wt % of the alumina component in terms of oxide thereof.

5. The insulator for spark plug according to claim 1, wherein the alumina-based sintered body contains 0.2 to 10.0 wt % of the β component in terms of oxide thereof.

6. A spark plug comprising:

an axial center electrode;

a metal shell provided around the center electrode in a radial direction;

a ground electrode fixed to the metal shell at one end thereof opposed to the center electrode; and an insulator provided around the center electrode in a radial direction interposed between the center electrode and the metal shell, wherein the insulator comprises an alumina-based sintered body comprising: $Al_2O_3$ as a main component; and at least one component, hereinafter referred to as "β component", selected from the group consisting of Ca component, Sr component and Ba component, wherein the alumina-based sintered body comprises particles comprising a compound comprising the β component and Al component, the compound having a molar ratio of the Al component to the β component of 4.5 to 6.7 as calculated in terms of oxides thereof, and has a relative density of 90% or more.

* * * * *